United States Patent [19]

Treiber

[11] 4,354,600

[45] Oct. 19, 1982

[54] NESTABLE BULK CONTAINERS

[76] Inventor: John Treiber, Chausee De la Hulpe 187-189 1170, Brussels, Belgium

[21] Appl. No.: 275,535

[22] Filed: Jun. 18, 1981

Related U.S. Application Data

[63] Continuation of Ser. No. 64,450, Aug. 7, 1979, abandoned.

[51] Int. Cl.[3] ..... B65D 21/04; B65D 45/28

[52] U.S. Cl. ..... 206/508; 206/515; 206/519; 220/1.5; 220/323

[58] Field of Search ..... 206/515, 518, 519, 520, 206/508; 220/1.5, 323

[56] References Cited

U.S. PATENT DOCUMENTS

| | | | |
|---|---|---|---|
| 622,546 | 4/1889 | Shaw | 220/323 |
| 1,457,155 | 5/1923 | Fey . | |
| 1,619,917 | 3/1927 | Brown | 220/323 |
| 1,899,342 | 2/1933 | McChesney | 206/515 |
| 1,973,924 | 9/1934 | Kloeb | 220/323 |
| 3,055,527 | 9/1962 | Cameron . | |
| 3,115,281 | 12/1963 | Somme . | |
| 3,469,730 | 9/1969 | Neff . | |
| 3,704,808 | 12/1972 | Gibson | 220/71 |
| 3,812,945 | 5/1974 | Lewis | 220/1.5 |
| 3,934,747 | 1/1976 | Needt . | |
| 4,000,827 | 1/1977 | Emery | 220/1.5 |

*Primary Examiner*—George E. Lowrance
*Attorney, Agent, or Firm*—Rogers, Bereskin & Parr

[57] ABSTRACT

A nestable bulk container made of metal, plastic, wood or combinations thereof, of frustum-like shape and conical, rectangular or square walls. The top of each container has a reinforcing plate therearound forming a rim which includes a lifting lug. Each container has a lid adapted to fit in the rim when the container is in use, the lid having ribs, and closure parts passing therethrough and adapted to engage openings in the rim. The main application of the invention is a returnable container for the shipping of bulk goods with each container having a ¼ ton to four ton capacity.

10 Claims, 8 Drawing Figures

NESTABLE BULK CONTAINERS

This is a continuation of application Ser. No. 064,450, filed Aug. 7, 1979, now abandoned.

This invention relates generally to nestable shipping containers.

The supply of bulk materials to construction projects or processing plants in developing countries or remote locations is a problem due to lack of proper port facilities (piers) to receive such bulk cargo. Roads or railroads to bring in these supplies from the nearest supply sources are usually non-existent. At some locations, suitable deep water or sound land is not available to construct a deep water wharf. At other locations, the volume of goods to be transferred from ship to shore and vice versa may not warrant building such a facility.

When such conditions exist, cement, for instance, is brought in to the closest shipping point in ninety pound bags, where several of these bags are stacked on a pallet, and wrapped with polyethylene sheeting, in preparation for movement to the final destination. Through several handlings of these pallets (from ship to a barge, then onto land, stacked several pallets high, then moved into a storage shed, later loaded onto trucks, moved miles inland until they are eventually stored near the point of use), considerable physical and weather damage occurs which adds to the final cost. Finally, the bags of cement are manually emptied and the wrappers disposed of. Altogether an arduous and costly exercise but, in some places, the only way.

More valuable bulk supplies (such as process additives, pastes, salts and powdery and dry bulk supplies) are usually supplied in disposable steel drums which add considerably to the delivered cost. Similarly, when the quantities being transported do not warrant deep water bulk shipping facilities, valuable products that are produced in a paste, slurry, granular, prill or chip form (anything that isn't in either liquid or solid block form) are usually shipped to the closest shipping point in disposable steel drums and, more recently, in either disposable or reusable rubber or neoprene bags. The latter are still in a more or less experimental stage and are not widely used. High costs remain a problem which is aggravated by puncturing or bursting in the case of bags.

To reduce wastage and at the same time keep container costs down, returnable rigid shipping containers, made of metal, plastic, etc. are often used for land shipment of bulk materials. However, in being returned, empty, they occupy as much space as when shipped full, again creating cost problems. The cost problem associated with the bulk size of empty containers being returned to source of supply is particularly acute in the case of ocean shipping. Ocean freight is normally payable on the basis of X pounds or Y cubic feet per ton, which ever generates the greater revenue to the carrier, thus making the returning of empty metal containers economically prohibitive.

To overcome these problems, a rigid container has been devised, as described herein, which when shipped empty is nestable in other similar containers in order that weight and not space becomes the governing cost factor.

Containers which can be dismantled in part and the parts stacked together have been devised as shown in U.S. Pat. Nos. 1,457,155; 3,055,529; 3,469,730 and 3,934,747. The structures of these containers are complex, expensive to manufacture, bulky, inconvenient to use or operate and their shapes often render them unstable in the conditions of many modes of shipping, for example by ocean vessel. U.S. Pat. No. 3,115,281 illustrates a further shipping container one which again involves a complex structure, costly to manufacture and no design features specifically addressed to accomodate compact nesting of a number of the containers.

The present invention is a rigid shipping container for carrying dry, moist, or liquid material in excess of ten kilograms in weight (upper limit of capacity only to be dependent on practical handling ability) compactly nestable with other such containers and further characterized by simplicity of design, strength, durability, stability and inexpensive cost of manufacture.

Accordingly, a nestable shaped container is provided having a bottom, a continuous peripheral side wall upstanding outwardly therefrom, a rim, a lid, a stiffening member located intermediate said rim and the top extremity of said side walls the stiffening member also serving as a lid seat between said rim and the top extremity of the side wall, a skirt depending from the bottom of the container and lifting lugs projecting upwardly from said rim; the rim containing spaced openings which co-operate with a closure means on the lid to close the container when not in a nested assembly.

This container, when empty, can have a considerable portion of it placed inside of or on top of, another empty unit, to the extent that the outside bottom surface of one can rest on the inside bottom floor of another; and then have another empty unit placed inside of, or on top of it, which can be repeated ad infinitum, limited only by practical handling ability, to provide for return shipping purposes a compact, nested assembly of empty units having a total cubic displacement of space (measured by overall length, width and height of all its components) that is a small fraction of the cubic displacement which would have been, had the same number of units been individually measured and the cubic displacement calculated. The nested assembly will also have a low centre of gravity due to the extent of the nesting of one container in another, thereby enhancing stability.

The invention and its advantages will be better understood with reference to the drawings, in which.

For the purpose of illustrating the invention and to exemplify its use this description will be concerned with a container having a rounded frustoconical shape. However, due to the differing bulk densities of materials which can be carried in these containers, it is not practical and it is not intended to standardize one size or one wall shape of a container according to this invention. For heavy materials such as lead concentrates it is preferable that the walls of the container be round, for lighter materials such as sulpher chips it is preferable that they be square or rectangular in order to use shipping space in the most exonomical way—a consideration when the bulk density of the material is less than sixty-five pounds/cubic feet.

Ideally, the containers should be of either two ton or four ton capacities, and possibly also of handcarrying size. But one-quarter or one-half ton units also are desirable. The two ton units can be handled by existing handling equipment that is designed for two ton cargo pallets. In order to achieve better economies of scale, the four ton unit may find application for large volume cargoes in order to minimize handling costs. Due to a heavy lift charge being applicable on items weighing over five tons, it is desirable to keep the overall loaded weight of the container below that limit. To achieve the most economical return shipping cost, there should be stacked as many containers as necessary to have the weight in tons equal the measure tons (forty cubic feet/-measure ton).

Figure 1:
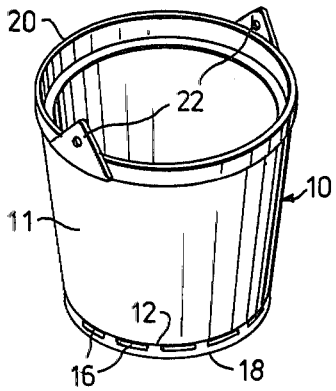
FIG. 1 is a perspective view of a preferred embodiment of the invention.
Figure 6:
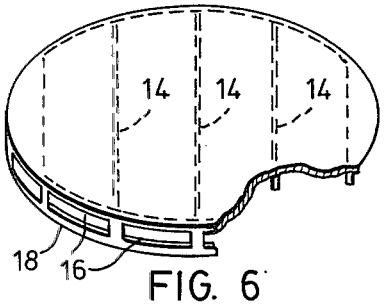
FIG. 6 is a perspective view of the bottom rim of the containers showing openings therein for a forklift.

Referring now in detail to the drawings, the invention is illustrated in non-limiting fashion with respect to a two ton (capacity) rounded frustoconical-shaped container unit 10 which may be used for shipping cement. As shown in FIG. 1 container 10 is made of steel, wood, fiberglass or aluminum with peripheral walls 11 which extend upwardly and outwardly from the bottom 12 of the container and which in the case of a two ton container for cement, would be approximately 3/32 to $\frac{1}{8}$ inch thick and four feet, nine inches high with a bottom 12 three feet, nine inches in diameter. As shown in FIG. 6, bottom 2 includes chordal supports 14 which act as guide for a forklift. A plurality of openings 16 for a forklift are provided about the periphery of the downturned wall which forms skirt 18 under each container which in the case of the container described would be approximately three inches.

Figure 3:
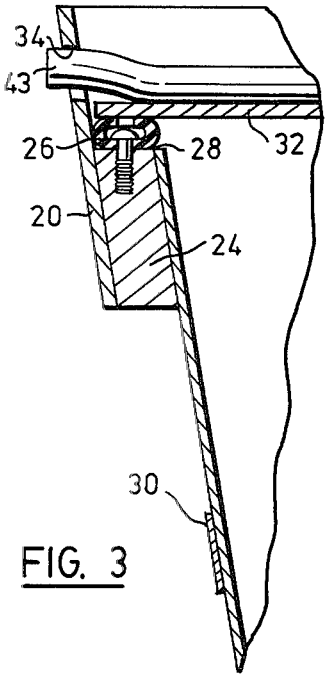
FIG. 3 is a detail sectional view of the upper part of a container showing closing means therefore.

An upper rim 20 also about three inches high is provided around the top of the illustrated container 10 with opposite lifting lugs 22 having central opening 24 therein, the lug also being about three inches high. A stiffener ring and lid seat 24 is interposed between rim 20 and the upper end of container 10. A rubber or other type of seal 26 is secured to seat 24 using bolt 28, as shown in FIG. 3.

Optionally, reinforcing metal straps 30 can be secured about midway around the periphery of the container wall.

A lid 32 is provided for each container for heavy goods, lid 32 will be of steel and for lighter goods it can be made of wood.

Figure 4:
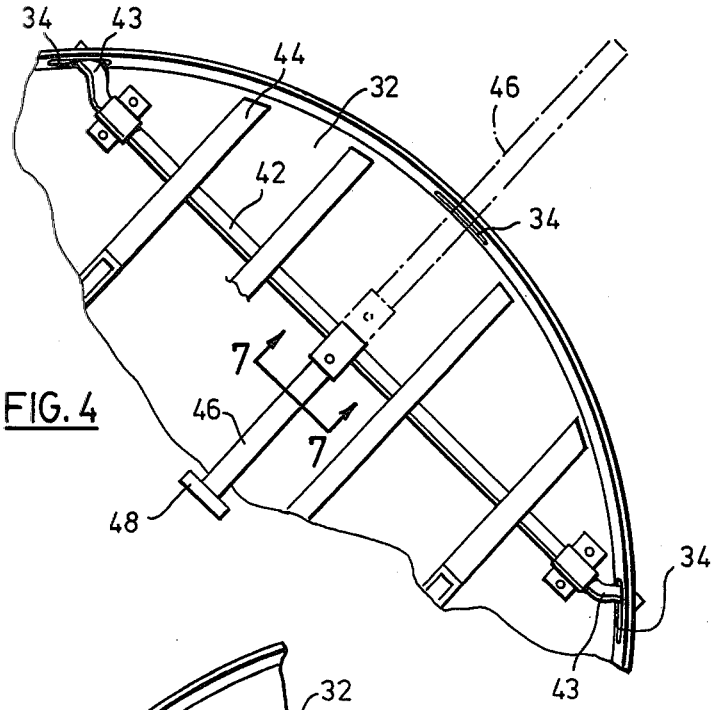
FIG. 4 is a partial top planar view of a lid for the containers.

A plurality of slots 34 at $\frac{1}{4}$ points of the circumference are provided in upper rim 20 to cooperate with a closure means. FIG. 4 shows a closure bar 42 passing under ribs 44 which permit stacking of full units and protect the closure mechanism. Closure handle 46 is in the position shown by dotted lines when in open position and when closed is in the position shown by solid lines with its free end secured under holding lug 48. When closure handle is in the closed position, the ends 43 of closure bar 42 are received in slots 34 as illustrated in FIGS. 3 and 4 and maintain lid 32 in tight contact with seal 26.

Figure 5:
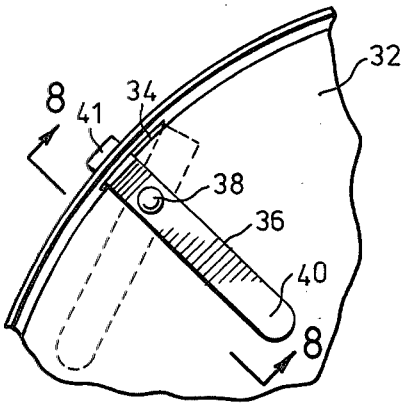
FIG. 5 is a partial view of a swing bar closure for the lid and container with the closed position being shown by solid lines.
Figure 8:
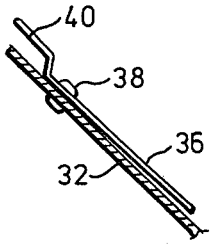
FIG. 8 is a cross-sectional view through line VIII—VIII of FIG. 5.
Figure 7:
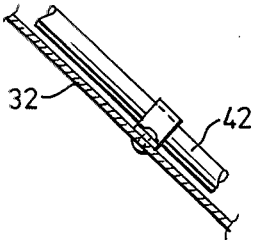
FIG. 7 is a cross-sectional view taken through line VII—VII of FIG. 4 and showing a closure bar passing through a reinforcing rib.

FIG. 5 shows an alternate closure means, a simple swing bar 36 with a bent handle 40, the bar pivotally attached to the top of lid 32 at pivot 38 such that its leading end 41 can be positioned in slot 34.

It will be appreciated that the closing lid 32 could be designed for either hand or mechanical operation, whichever is desirable. Provisions would be made for lifting of the containers by forklift trucks, cranes or specially-provided lifting devices. Tilting, for purposes of emptying the contents of the containers, would be achieved through either special tilting machines or by simply attaching a second hook to the skirt 18 of the bottom and lifting it above the height of the lifting lugs.

For small-size containers (i.e. one-quarter ton or eight cubic feet) the container construction would be similar to steel drums (oil barrel) except that the drum walls would define a frustum-like shape as described above. Lid design and lid attachment can be as for steel drums with contracting circumferencial clamps.

Figure 2:
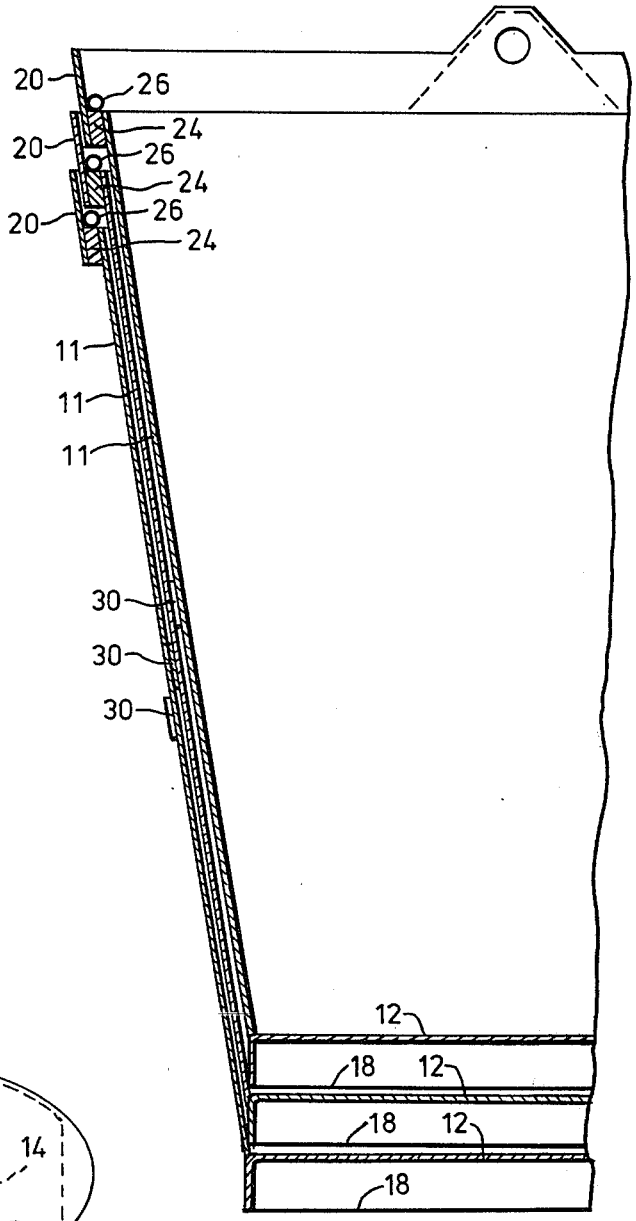
FIG. 2 is a partial cross-sectional view of a typical nesting assembly.

From the above description, the operation and use of the invention will be evident to those skilled in the art to which it relates. A simple and inexpensive container design has been provided which as illustrated in FIG. 2 facilitates, by means of an easily-removed, full-size lid, rapid filling and emptying and facilitates nesting of the containers when empty and with lid removed to the extent that the skirt 18 of one container will nest on the bottom 12 of the container below. A nested assembly thereby occupies a minimum amount of space. It will be appreciated that to avoid the possibility of the skirts jamming the containers when nested, the skirt of each container could be inset a fraction from the peripheral edge of bottom 12. Alternately, the bottom extremity of skirt 18 could be slightly tapered or rounded. It will also be appreciated that with the container, as described, there are no protrusions into or throughout the container, thereby allowing the use of plastic liners for water-proofing or vermin-proofing the contents.

Without further analyses, the foregoing will so fully reveal the essence of this invention that those skilled in the art can by applying current knowledge thereto readily adapt it for various applications without omitting certain features which can constitute essential characteristics of the generic or specific aspects of this invention. It will also be appreciated that the invention can take various forms and accomodate various changes consistent with utilizing the essential characteristics of this invention within the meaning and range of equivalency of the following claims. The invention, therefore, is not to be restricted except as is necessitated by the prior art.

What I claim as my invention is:

1. A nestable, closeable and stackable container having a bottom, a continuous straight-line peripheral side wall upstanding outwardly therefrom in the shape of a frustum, a top peripheral rim defining a plurality of spaced openings, a stiffening member located intermediate said rim and the top extremity of said side wall, a load transferring skirt downwardly dependent from the bottom of said container adjacent the periphery of said bottom, a load supporting lid adapted to sit on said stiffening member, said lid having upstanding chordal reinforcing ribs, closure means comprising at least two closure members each having an actuating portion and at least one closure portion, said actuating portion moving in a plane generally parallel to and directly adjacent said lid to move each closure portion between a first closed position in which the closure portion is engaged in a rim opening securing said lid against said stiffening member and a second open position in which the closure portion is disengaged from said rim opening whereby said closure means in said closed position lies generally flush to said lid, and whereby with said lid closed, said containers can be stacked with the skirt of an upper container resting on the chordal reinforcing ribs on the lid of a lower container the weight of a stacked container passing downward onto the lid, then to the stiffening member, then to the side wall and finally to the skirt of the container below, and with said lid removed said containers can be nested together with the skirt of an upper container resting directly on the bottom of a container below.

2. The invention as claimed in claim 1 wherein the actuating portion of said closure member is elongate having closure portions disposed from either end thereof, and further comprising a handle fixed to said actuating portion to rotate said actuating portion in said plane and move said closure portions between said first and second positions, and said chordal reinforcing ribs define openings adjacent said lid for traversing the actuating portion of said closure member and wherein in said second closed position, said handle lies between said chordal reinforcing ribs and generally flush to said lid.

3. The invention as claimed in claim 1 wherein said closure members are spaced about the periphery of said lid, one associated with each of said rim openings, and comprise a lever having a closure end portion, said lever pivoted to said lid to move said closure end portion between said first and second positions.

4. The invention as claimed in claim 1, 2 or 3 wherein the wall of said frustoconical containers are circular.

5. The invention as claimed in claim 1 further comprising lifting lugs projecting upwardly from said rim.

6. The invention as claimed in claim 1, further comprising fork-lift engaging openings spaced about the periphery of said skirt.

7. The invention as claimed in claim 1, 2 or 3, further including sealing means secured to said lid seat.

8. The invention as claimed in claim 1, wherein said bottom further defines chordal supports on the under surface thereof.

9. The invention as claimed in claim 4 further including reinforcing means secured to the outside of the wall of said container intermediate the top and bottom thereof.

10. The invention as claimed in claim 9 wherein said reinforcing means consists of a metal strap.

* * * * *